US011993355B2

(12) United States Patent
Fontaine et al.

(10) Patent No.: US 11,993,355 B2
(45) Date of Patent: May 28, 2024

(54) STRUCTURES AND METHODS FOR MITIGATING IMPLOSION PRESSURE SPIKES

(71) Applicant: University of Rhode Island Board of Trustees, Kingston, RI (US)

(72) Inventors: Dillon Fontaine, Smithfield, RI (US); Arun Shukla, Wakefield, RI (US)

(73) Assignee: University of Rhode Island Board of Trustees, Kingston, RI (US)

( * ) Notice: Subject to any disclaimer, the term of this patent is extended or adjusted under 35 U.S.C. 154(b) by 397 days.

(21) Appl. No.: 17/515,933

(22) Filed: Nov. 1, 2021

(65) Prior Publication Data

US 2022/0144396 A1 May 12, 2022

Related U.S. Application Data

(60) Provisional application No. 63/110,988, filed on Nov. 7, 2020.

(51) Int. Cl.
*B63G 8/04* (2006.01)
*B63B 3/13* (2006.01)

(52) U.S. Cl.
CPC . *B63G 8/04* (2013.01); *B63B 3/13* (2013.01)

(58) Field of Classification Search
CPC ..... B63G 8/04; B63G 2008/002; B63B 3/13
USPC ..... 114/312, 313, 341, 342
See application file for complete search history.

(56) References Cited

U.S. PATENT DOCUMENTS 3,622,437 A * 11/1971 Hobaica ..... B29C 70/66 473/118
4,598,106 A * 7/1986 Utsugi ..... B63G 8/24 521/182
10,173,753 B1 * 1/2019 Olsson ..... B63G 8/22

* cited by examiner

*Primary Examiner* — Daniel V Venne
(74) *Attorney, Agent, or Firm* — Hinckley, Allen & Snyder, LLP; Stephen Holmes

(57) ABSTRACT

Structures designed to mitigate implosion pressure spikes through the use of an external sacrificial confining structure. Such improved structures can, in some embodiments, completely surround the existing structures that are at a high risk of imploding. The improved structures can slow the rate at which the surrounding fluid media volume is consumed by providing resistance to flow into the enclosure.

20 Claims, 8 Drawing Sheets

RESULTS OF AN EXPERIMENT SHOWING DEFLECTION OF OUTER TUBE AND EMITTED PRESSURE

PRESSURE SIGNATURE AND SCALOGRAM FROM ABOVE EXPERIMENT

A COMPARISON OF IMPLOSION PHENOMENA OF A TUBE ALONE AND A TUBE WITH THE DEVICE IN PLACE
NOTE: WITH THE DEVICE IN PLACE, THE DURATION OF SUCTION IS GREATLY DRAWN OUT AND ITS MAGNITUDE IS NEARLY CUT IN HALF: THE LARGE OVER-PRESSURE SPIKE IS ABSENT; AND THE AMPLITUDE OF SUBSEQUENT PRESSURE OSCILLATIONS IS ALSO GREATLY REDUCED.

| | MAX. OVER-PRESSURE (MPa) | MAX. UNDER-PRESSURE (MPa) | OVER-PRESSURE IMPLUSE (Pa*s) | UNDER-PRESSURE IMPUSLE (Pa*s) | DURATION OF UNDER-PRESSURE (ms) |
|---|---|---|---|---|---|
| WITHOUT DEVICE | 2.741 | -0.640 | 356.2 | -344.6 | 1.515 |
| WITH DEVICE | 0.306 | -0.341 | 173.0 | -246.2 | 5.968 |
| DECREASE (%) | 88.9 | 46.7 | 51.4 | 28.6 | -294 |

SUMMARY TABLE COMPARING PERFORMANCE WITH AND WITHOUT THE DEVICE IN PLACE
NOTE: DECREASES IN PRESSURE MAGNITUDES AND IMPULSES ARE ALL DESIRABLE CHARACTERISTICS; WHEN COUPLED WITH LOWER UNDER-PRESSURE IMPULSE, THE INCREASE IN DURATION OF THE UNDER-PRESSURE REGION (NEGATIVE DECREASE) IS ALSO DESIRABLE.

FIG. 6

STRUCTURES AND METHODS FOR MITIGATING IMPLOSION PRESSURE SPIKES

CROSS REFERENCE TO RELATED APPLICATION

This application claims benefit to earlier filed U.S. Provisional Patent Application Ser. No. 63/110,988, filed Nov. 7, 2020, the entire contents thereof are incorporated herein by reference.

BACKGROUND OF THE DISCLOSURE

The present disclosure generally relates to structures and methods for mitigating implosion pressure spikes through a sacrificial confining structure.

Aquatic submersible vessels are often exposed to large external pressures. For example, when the submersible dives to increasing depths in water various structures are at risk of failure and can become unstable at a certain critical pressure values. At those critical pressure values, those structures are at risk of violently reconfiguring their structure as a result of the increasing stress. Such a reconfiguration, or implosion, is normally a very short duration, high energy event. The events often release large pressure spikes that travel through the surrounding environmental fluid media (air/water) and that can interact with, and damage, nearby structures. In the case of military vehicles, this can potentially set off unwanted and undesired on-board weaponry or explosives.

The prior art designs fail to address the structural shortcomings pf the prior art in many types of aquatic vessels and, as such, these vehicles are unable to increase their current maximum depths. Prior art solutions, including internal energy-absorbing foams, internal coatings with soft materials/plastics, or internal bracing have their own attendant problems that fail to fully achieve the desired outcome. For example, energy absorbing foam fillers occupy valuable interior space and are only about 20-30% effective. Additionally, exterior coatings may suffer from degradation of the coating material over time and are less effective than foam fillers. Generally, the prior art designs are often expensive, and require more materials which in turn results in heavier parts, and moreover, those allegedly stronger parts will often collapse more violently when they do fail.

Thus, there is a need for improved submersible structures that are able to withstand an increase in pressure without implosion, and in the event of an implosion, improved structures which protect parts from the damaging effects of nearby collapses and prevent cascading damage from catastrophic events.

SUMMARY OF THE DISCLOSURE

The present disclosure is directed towards structures that are designed to allow for mitigation of implosion pressure spikes through a sacrificial confining structure. Such improved structures can, in some embodiments, completely surround the existing structures that are traditionally at a high risk of imploding. The improved structures can slow the rate at which the surrounding fluid volume is consumed by providing resistance to flow into the enclosure. This flow resistance can cause the confining structure to couple its stiffness with the inner protected structure during the moments of collapse. Additionally, or alternatively, the confining structures can be deformable so as to consume energy through plastic deformation. By drawing out the duration of the high energy event through structural coupling, providing physical impedance to any outgoing pressure waves, and consuming the collapse energy into other energy-intensive processes, the damaging effects of the implosion can be mitigated and reduced. In some instances, pressure spikes emanating from an implosion event may be nearly entirely mitigated.

BRIEF DESCRIPTION OF THE FIGURES

While the specification concludes with claims particularly pointing out and distinctly claiming particular embodiments of the instant disclosure, various embodiments of the disclosure can be more readily understood and appreciated from the following descriptions of various embodiments of the disclosure when read in conjunction with the accompanying drawings in which:

FIG. 6 is a summary table comparing performance with and without a shroud;

DETAILED DESCRIPTION

Figure 1:
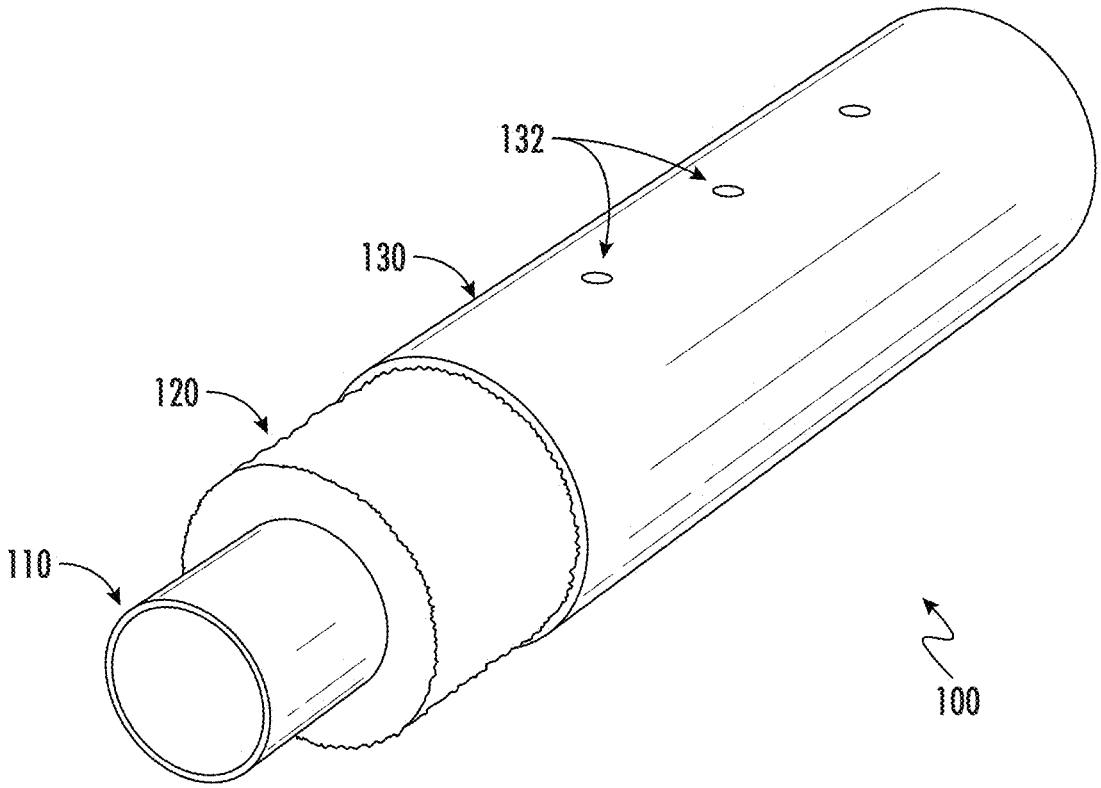
FIG. 1 is an exploded perspective view of a first exemplary embodiment according to the instant disclosure.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present disclosure is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal. While many of the embodiments discussed herein are in reference to underwater vehicles, unmanned or manned, this is merely an example as this disclosure can have use in a variety of fluids and vehicles.

In general, as shown in FIGS. 1-9, the structures, or protective assembly, 100 as illustrated and described in the instant disclosure seek to mitigate implosion pressure spikes in submersible vessels, e.g. submersible vessel 240, and thus protect other surrounding structures without excess damage at certain critical pressures. The instant structures and assemblies provide an externally located deformable part, or outer confining structure 130, that sacrificially couples to an internal structure, or inner hollow structure 110, through the surrounding fluid media 120 and collapses with the internal structure 110 to prevent additional damage to the surrounding structures. This is accomplished by reducing the fluid media volume that lowers the relative pressure of trapped water within a fluid media space 120 between the inner structure 110 and the outer confining structure 130. During the implosion event, external fluid media attempts to ingress into the trapped fluid media space 120 through openings 132*a*, 132*b* in the external structure 130 to relieve this pressure difference about the same, but the flow is restricted by the size of the openings 132*a, b* in the external, sacrificial, structure 130. The pressure difference created about the external structure (shroud) 130 can result in a load transfer. In an exemplary embodiment, inner 110 and outer 130 concentric tubes can be momentarily coupled through the trapped water 150 and use the relatively lower pressure of the same and the outer tube 130 stiffness to slow down the implosion event of the inner tube 110. The slower implosion can result in less violent shockwaves. For example, the exemplary embodiments disclosed herein can mitigate up to 90% of the damaging shockwaves released by a collapsing structure.

As graphically shown in FIGS. 3-6, structures subject to external pressure in a fluid may enter dynamic instability at a critical pressure. At such a critical pressure, static equilibrium can then be satisfied by more than one configuration of the subject structures, and thus the structure may spontaneously jump to this new configuration (implosion). In certain cases, there can be an associated volume change with this new configuration and energy must be supplied to the fluid to counteract the thermodynamic effect of changing its volume, as well as energy consumed in deforming the structure itself. In an open environment, the consumed volume is easily taken up by the ambient fluid, and so the implodable feels minimal resistance to collapse. Areas of the implodable structure will move inward, evacuating the volume they once occupied, which creates a suction zone that attempts to draw in surrounding fluid. The implosion event proceeds until the walls of the implodable make contact, which suddenly arrests their motion and that of the fluid particles flowing into the voids created by the inwards movement. The sudden movement of the walls will in turn generate a pressure spike in which the fluid particles compress as they are suddenly halted, then rebound with great force. Damage to nearby structures can be caused by either or both of two aspects of the implosion: 1) the suction created as the collapse begins, and 2) the violent pressure spike created when wall contact is achieved.

The instant disclosure provides an assembly 100 which includes an external sacrificial structure, or outer confining structure, or shroud, 130 with flow openings 132 that can mitigate the magnitude of the pressure spikes created during aspects of an implosion. This semi-open external sacrificial shroud, or shroud, 130 can enclose the implodable structure 110 completely except for a series of strategically placed holes 132 that allow water, or other surrounding fluids 150, to slowly move across the boundary created by the external shroud structure 130. In this way, the pressure on the interior and exterior surfaces of the shroud 130 can be allowed to equalize when pressure changes slowly, but when subjected to sudden changes in pressure, the resistance to flow prevents immediate equalization and so the shroud 130 feels a pressure difference. Thus, when the internal implodable structure experiences a slow change in pressure, as would occur during dives in the ocean, the external shroud 130 structure feels little to no pressure difference, but when the implodable structure 110 begins to collapse and pressure changes rapidly, the shroud 130 participates as is discussed below to mitigate any rapid pressure change.

Figure 2:
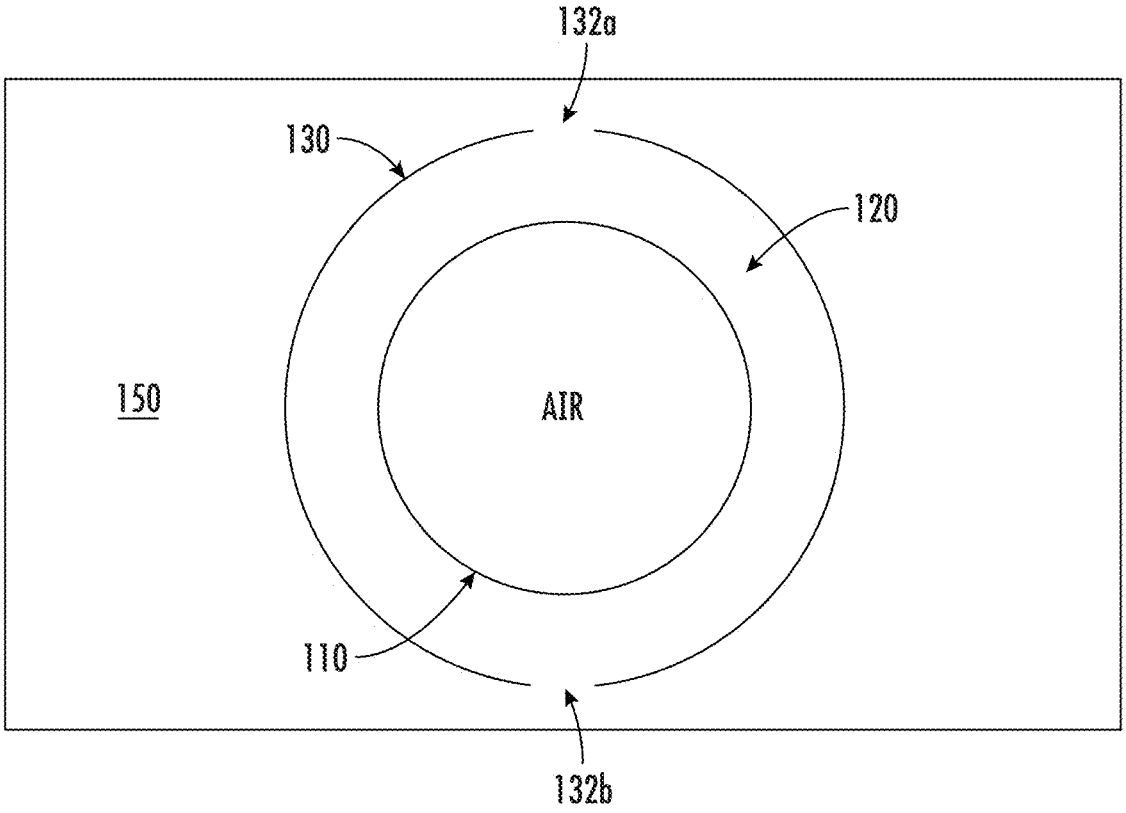
FIG. 2 is a cross-sectional view of the first embodiment of FIG. 1.
Figure 3:
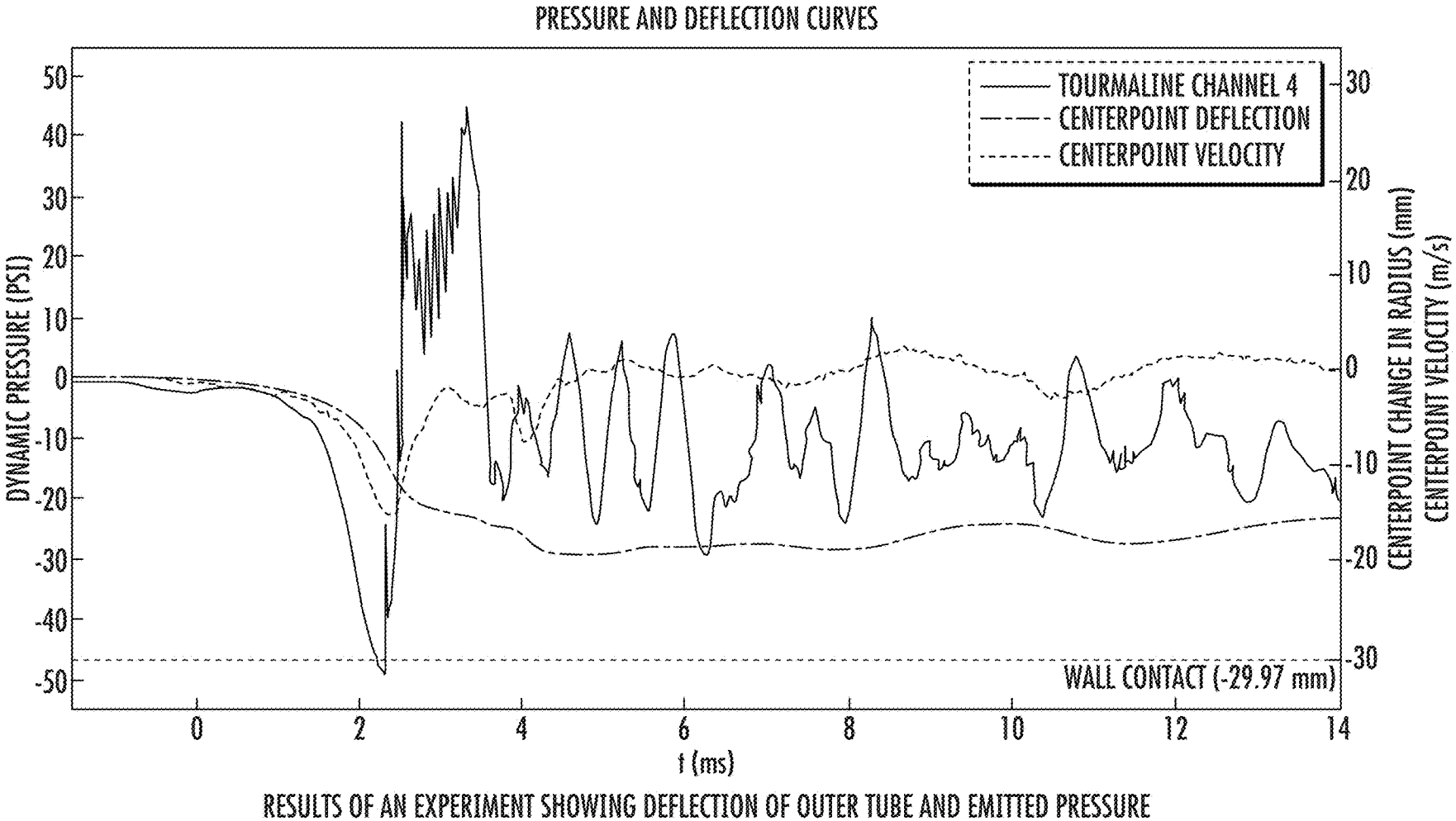
FIG. 3 is a graph showing experimental results.
Figure 4:
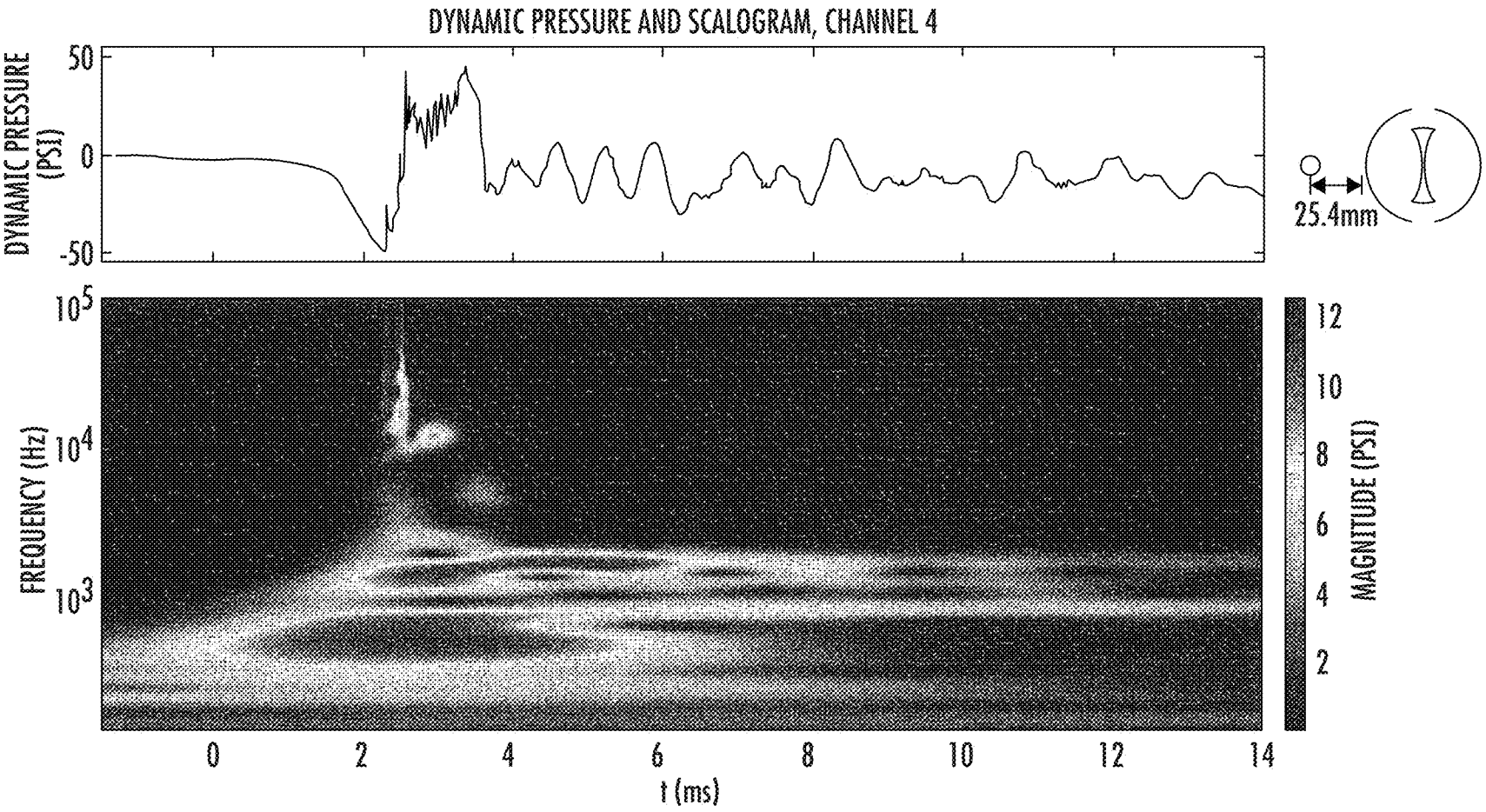
FIG. 4 is a graphical representation of the pressure signature and scalogram of experimental results.
Figure 5:
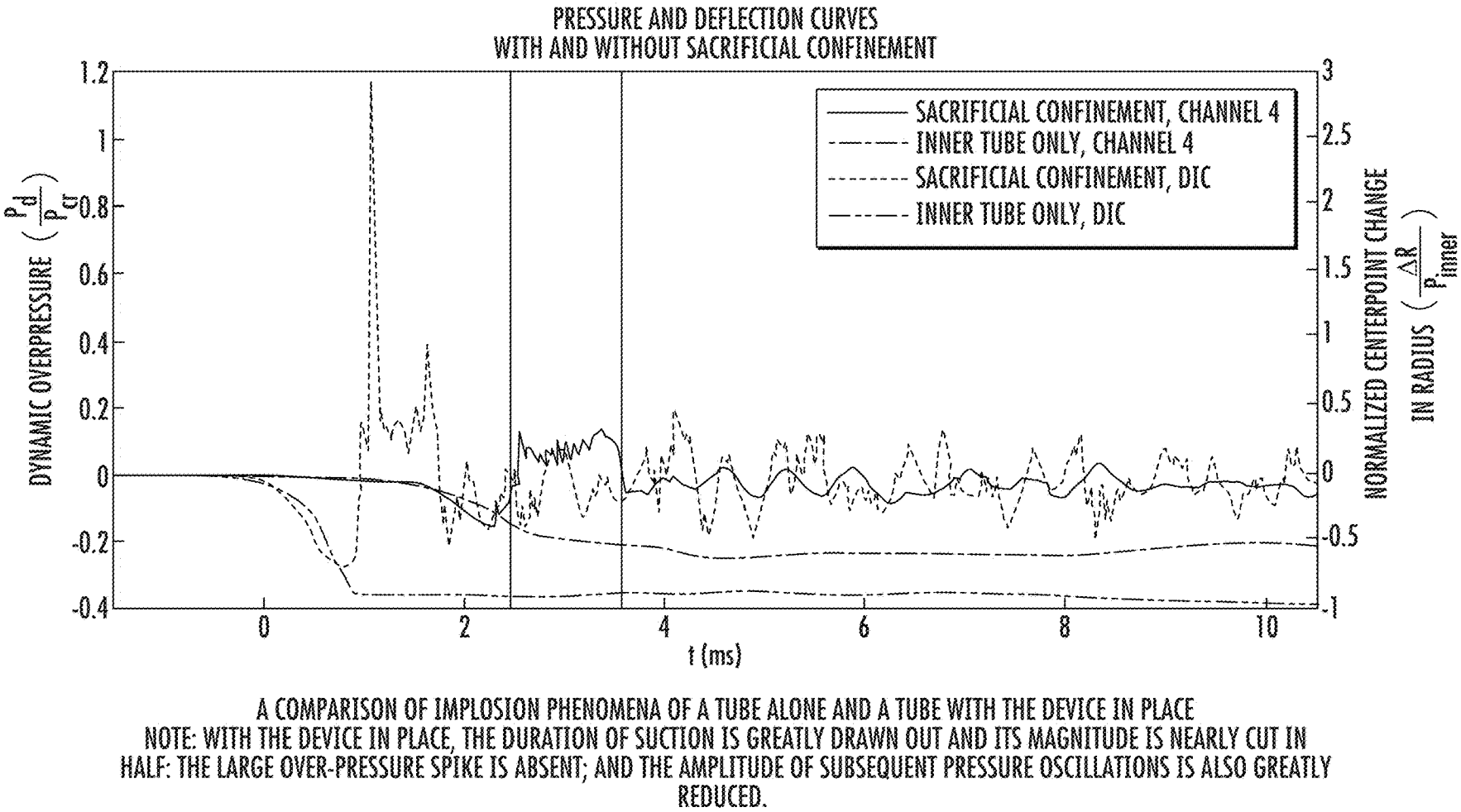
FIG. 5 is a graph showing a comparison of an implosion phenomena of an internal structure with and without the shielding of FIG. 1.
Figure 7:
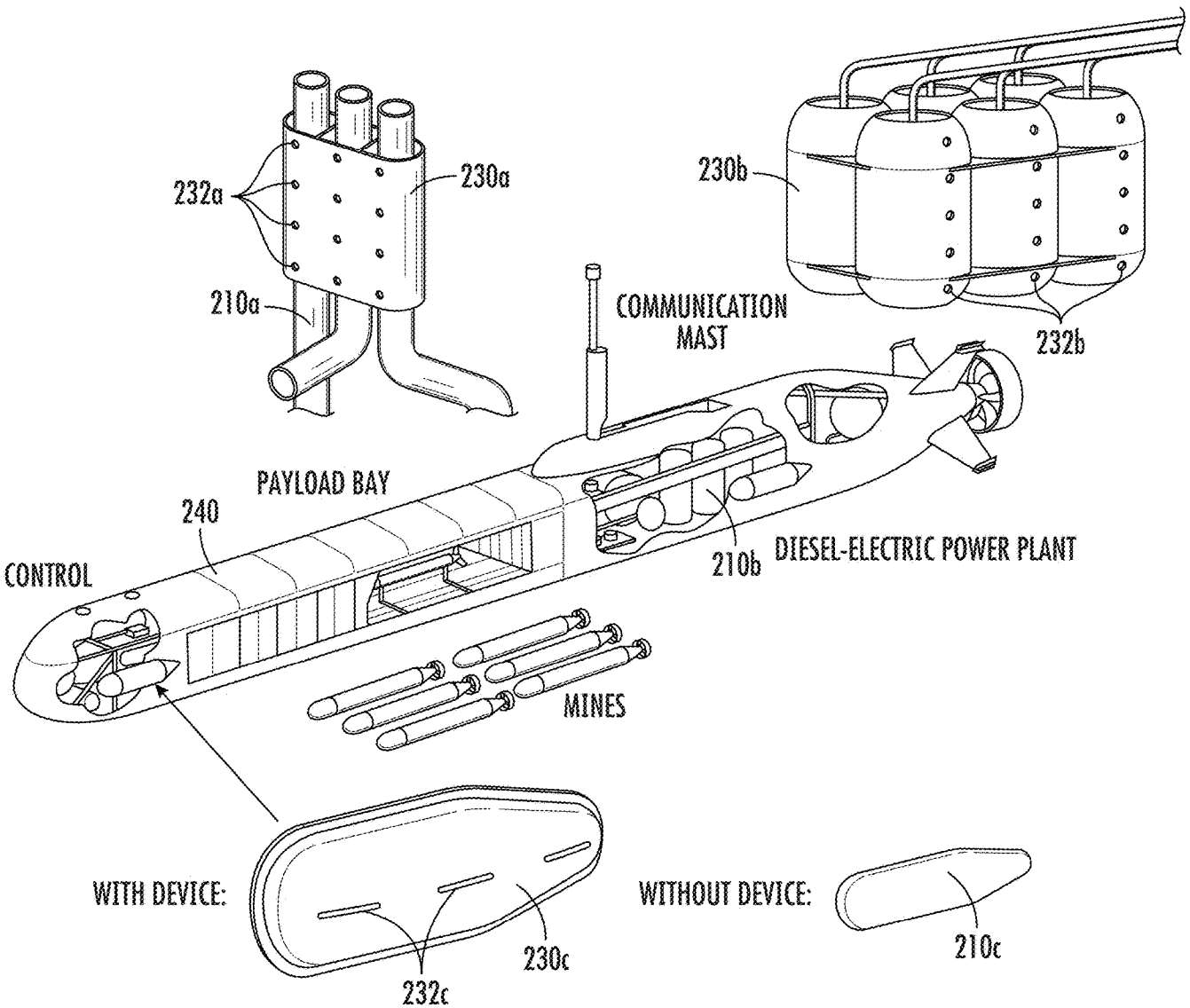
FIG. 7 shows various exemplary embodiments of the sacrificial confining structures implemented on and within a UUV.
Figure 8:
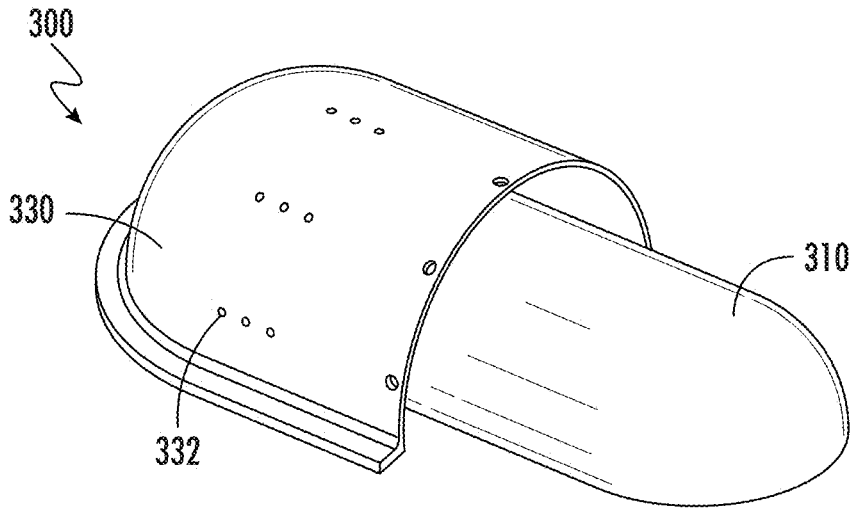
FIG. 8 is an alternative embodiment with a multipart confining shroud surrounding a hollow surface structure.
Figure 9:
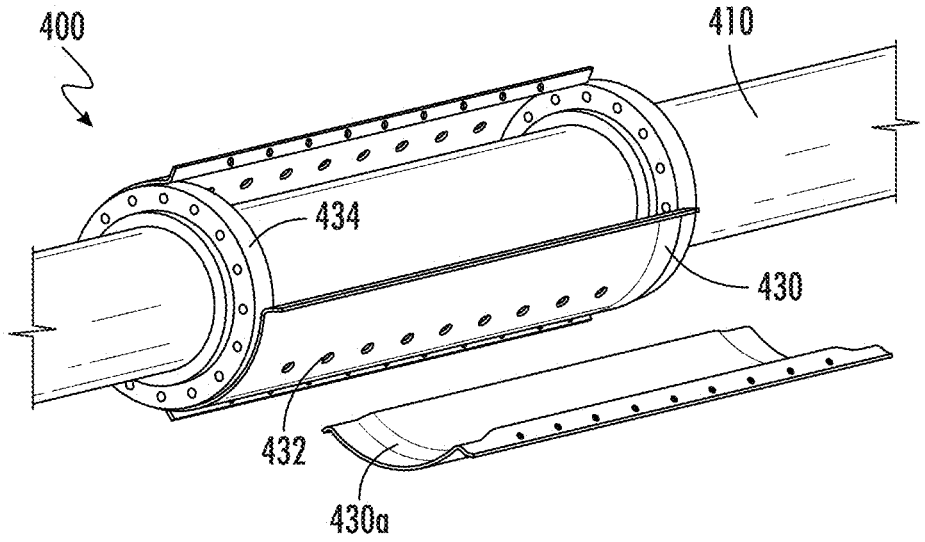
FIG. 9 is another alternative embodiment with a multipart confining shroud surrounding a pipe structure.

Advantageously, the outer confining structures 230*a*, 230*b*, 230*c* may be outfitted around respective inner hollow structures 210*a*, 210*b*, 210*c* of any of the common shapes used in undersea vehicle applications 240, including but not limited to spherical, semi-spherical, cylindrical, conical frusta, toroidal, or combinations thereof, as seen in FIG. 7. The instant device, or shroud 430, can be attached by way of a frame or other support structure 434 that may be anchored to the enshrouded component directly or anchored to the larger structure that the enshrouded component is a part of, as seen in FIG. 9. In some embodiments, the shroud, or outer confining structure is a monolithic structure 130, 230*a-c*, as shown in FIGS. 1, 2, and 14. In some alternative embodiments, the device need not be a single monolithic structure, but may be comprised of several sub-components that when fastened together by pin, screw, rivet, or other fastener form a shroud that functions similarly to a monolithic device, shown in FIGS. 8 and 9. This multi part assembly may be used to facilitate installation onto new structures or for retrofitting onto pre-existing structures. FIG. 1 shows a perspective view of a monolithic device 130 installed on a pipe shaped vessel or ballast tank 110, which is attached to a larger structure. In comparison, FIG. 8 shows an embodiment 300 having one half of a multipiece device 330 installed on a capsule shaped vessel or ballast tank 310, which in turn is attached to a larger structure. Similar to FIG. 8, FIG. 9 shows another alternative embodiment a multipiece shroud 430, with one piece 430*a* removed for ease of viewing, connected on two flanges 434 that surround a pipe 410.

The device may not contact the vessel it protects in any way. In contrast, the device can be anchored to the overall larger structure, that surrounds the protected structure, by a flange around its periphery, as shown in FIGS. 1, 2, and 9, for example. The shape of the protected part is mirrored in the shape of the shroud, and a small gap, or fluid media space, 110 is provided between them, as shown in the various embodiments of FIGS. 1, 2, and 7-9. The small gap, or trapped fluid media space, 110 is filled with the surrounding fluid media 150 that passes through the various openings 132, 132*a*, 132*b*, see e.g., FIGS. 1 and 2.

In the illustrated embodiment of FIG. 9, a device 400 has been retrofitted around a section of pipe or conduit 410. The illustrated embodiment of the device 400 is comprised of four sections, or parts, 430*a* that when fastened together function as if they were a single shroud 430. These sections 430*a* can allow the device to be implemented without any kind of disassembly of the protected structures 410. The individual sections 430*a* can rest on existing flanges 434 on the ends of each pipe section. These flanges 434 may not form part of the device itself. As it applies to existing, in-service underwater drones or unmanned underwater vehicles (UUV's), the device may be comprised of any number of sections to facilitate retrofitting, the sections need not be sealed with respect to one another, and fastening is only required to ensure a comparable level of structural integrity as would be in the case of a monolithic structure (i.e. fasteners are only there to hold the parts together as a single unit).

As noted above, the device is equipped with one or a plurality of perforations, as shown in FIGS. 1, 12, and 7-9. The perforations, or openings, may vary in their location and density to suit individual applications, see for example the variety of openings 132, 232*a-c*, 323, 432 in various embodiments of FIGS. 1, 12, and 7-9. In the exemplary embodiments, the total size (area) of the perforations, may be up to about 25-30% of the total surface area of the sacrificial shroud. After the total area of the openings exceeds 25-30% of the total surface area, it is suspected that the effectiveness of the shroud may diminish to the point that the addition of the device is unjustified and other existing methods of mitigation would begin to be as effective. Nevertheless, in all cases, there must exist at least one path for pressure to equalize on both sides of the shroud, meaning that at least one perforation must exist, although the size can be made arbitrarily small depending on the rate at which the protected component changes its ambient pressure (i.e., if a UUV, the rate at which it changes depth and thus ambient pressure. A small-time rate of change of pressure can be handled by a single very small opening). The density and location of the holes is arbitrary, as long as the area condition is met, although locating a majority of the openings far from each other and far from areas with the highest expected inwards deformation increases effectiveness. Any shape of perforation is possible, from round holes to slots to any other geometry, various opening shapes 232*a*, 232*b*, 232*c* are shown in FIG. 7. Round holes 232*a*, 232*b* are believed to weaken the structure the least and thus increase effectiveness. Other shapes, including elliptical or pill shaped openings 232*c* are shown in FIG. 7, are thought to not be as effective but will still function.

The external sacrificial shroud structure may be manufactured from any material commonly used in the construction of the internal hollow structures it is designed to protect. For example, a ductile metal such as any grade of stainless steel, aluminum alloy, nickel based super-alloy, plain or high carbon steel, and copper alloy and derivatives will be most effective due to their ability to deform without outright failure and consume energy in the process. It is contemplated that other materials such as plastics including nylon, PVC, acetal, or other polymers may also be effective, but their lower stiffness-to-weight ratios and lack of ductile deformability may limit their application. Polymer matrix composites can also be applicable, provided they are designed in a way to not suffer loads which would cause them to catastrophically fail during use. Alternatively, any material commonly used in the structure of protected components is a viable material for the device.

In use, the present structural assembly functions in the following order. Following the phenomenon in time, the implodable internal structure can begin to collapse. The sides of the implodable internal structure can begin to move inwards as the implodable decreases its volume. This decrease in volume creates a low-pressure region in the immediately surrounding fluid (trapped fluid), drawing it towards the collapsing walls. The surrounding fluid seeks to relieve this low pressure by drawing additional fluid from outside the containment shroud through the small orifices, but the resistance to such a fast flow is great, in magnitude, due to the size of the orifices and the mechanical properties of the fluid. As a result of the resistance to a fast flow, much of the low-pressure forces can be transferred to the shroud. Fluid can slowly begin to enter the region of lower pressure through the orifices but in the time it takes to do so the increased stiffness of the system (the stiffness of the implodable plus the proportion of the load taken by the shroud) slows the collapse of the implodable. The wall contact in the implodable structure can be finally achieved but has been slowed to the point that the deceleration of fluid is of a magnitude that creates a drastically smaller pressure pulse. Additionally, because a lesser volume of fluid (only that trapped between the shroud and implodable) is allowed to participate in the event, this also helps to mitigate the pulse. By the same logic, because much of the load is taken up by the containment shroud during the event, the fluid outside of the shroud experiences a much lower suction pressure, also decreasing the damaging effects of this mechanism. Additionally, or alternatively, any pressure pulse emanating from inside the shroud must pass through it in order to cause damage to other structures. The rigidity and impedance of the shroud to pressure waves is a final mitigator of the damaging implosion pressure pulse.

While there is shown and described herein certain specific structures representing various embodiments of the disclosure, it will be manifest to those skilled in the art that various modifications and rearrangements of the parts may be made without departing from the spirit and scope of the underlying inventive concept, and that the same is not limited to the particular forms herein shown and described except insofar as indicated by the scope of the appended claims.

What is claimed:

1. A protective assembly for mitigating implosion pressure spikes, the protective assembly comprising, an inner hollow structure;

an outer confining structure shaped to mirror the inner hollow structure and offset outwardly from the inner hollow structure defining a fluid media space therebetween; and at least one opening in the outer confining structure configured to allow fluid media to pass therethrough.

2. The protective assembly of claim 1, wherein the at least one opening is circular.

3. The protective assembly of claim 2, wherein the at least one opening is a plurality of openings.

4. The protective assembly of claim 2, wherein a total area of the at least one opening does not exceed 30% of a surface area of the outer confining structure.

5. The protective assembly of claim 1, wherein the at least one opening is a plurality of openings.

6. The protective assembly of claim 1, wherein a total area of the at least one opening does not exceed 25% of a surface area of the outer confining structure.

7. The protective assembly of claim 1, wherein the inner hollow structure is a portion of an unmanned underwater vehicle.

8. The protective assembly of claim 1, wherein the outer confining structure is made of a stainless steel, an aluminum alloy, a nickel based super-alloy, carbon steel, or a copper alloy.

9. The protective assembly of claim 1, wherein the outer confining structure is monolithic.

10. The protective assembly of claim 1, where in the outer confining structure is made of a plurality of pieces.

11. The protective assembly of claim 10, wherein the plurality of pieces are fixed together.

12. The protective assembly of claim 1, wherein a fluid is disposed between the inner hollow structure and the outer confining structure.

13. The protective assembly of claim 2, wherein a fluid is disposed between the inner hollow structure and the outer confining structure.

14. The protective assembly of claim 5, wherein a fluid is disposed between the inner hollow structure and the outer confining structure.

15. The protective assembly of claim 6, wherein a fluid is disposed between the inner hollow structure and the outer confining structure.

16. A protective assembly for mitigating implosion pressure spikes in a hollow structure, the protective assembly comprising:

an outer confining structure shaped to mirror an outer surface of the hollow structure and offset outwardly from the inner hollow structure defining a fluid media space therebetween; and at least one opening in the outer confining structure configured to allow fluid media to pass therethrough.

17. The protective assembly of claim 16, wherein the at least one opening is circular.

18. The protective assembly of claim 17, wherein the at least one opening is a plurality of openings.

19. The protective assembly of claim 17, wherein a total area of the at least one opening does not exceed 30% of a surface area of the outer confining structure.

20. The protective assembly of claim 16, wherein the at least one opening is a plurality of openings.

* * * * *